US006217145B1

(12) United States Patent
Ito et al.

(10) Patent No.: US 6,217,145 B1
(45) Date of Patent: Apr. 17, 2001

(54) INK-JET PRINTER

(75) Inventors: Takuro Ito, Shizuoka-ken; Hitoshi Ushiogi, Mishima; Yasuhiro Suzuki, Numazu, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/120,896

(22) Filed: Jul. 22, 1998

(30) Foreign Application Priority Data

Jul. 25, 1997 (JP) ..... 9-200039

(51) Int. Cl.[7] ..... B41J 2/165
(52) U.S. Cl. ..... 347/28; 347/29
(58) Field of Search ..... 347/28, 36, 29, 347/23

(56) References Cited

U.S. PATENT DOCUMENTS 4,746,938 * 5/1988 Yamamori et al. ..... 347/28
5,412,411 * 5/1995 Anderson ..... 347/28

FOREIGN PATENT DOCUMENTS

362090253 * 4/1987 (JP) ..... 347/28

* cited by examiner

*Primary Examiner*—N. Le
*Assistant Examiner*—Shih-Wen Hsieh
(74) *Attorney, Agent, or Firm*—Frishauf, Holtz, Goodman, Langer & Chick, P.C.

(57) ABSTRACT

An ink-jet printer includes a rotary drum for carrying a print sheet, a print head arranged above the rotary drum for printing an image by ejecting ink onto the print sheet, a washing board facing the print head to wash an end surface of the print head with ink ejected from the print head, and a control unit for controlling at a non-printing time the washing board to be set at a cleaning position located between the print head and the rotary drum and the print head to eject ink therefrom. Particularly, the washing board has grooves which receives an entire end surface of the print head and a drain section for draining the ink ejected from the print head and flowing in contact with the end surface of the print head within the groove section.

11 Claims, 6 Drawing Sheets

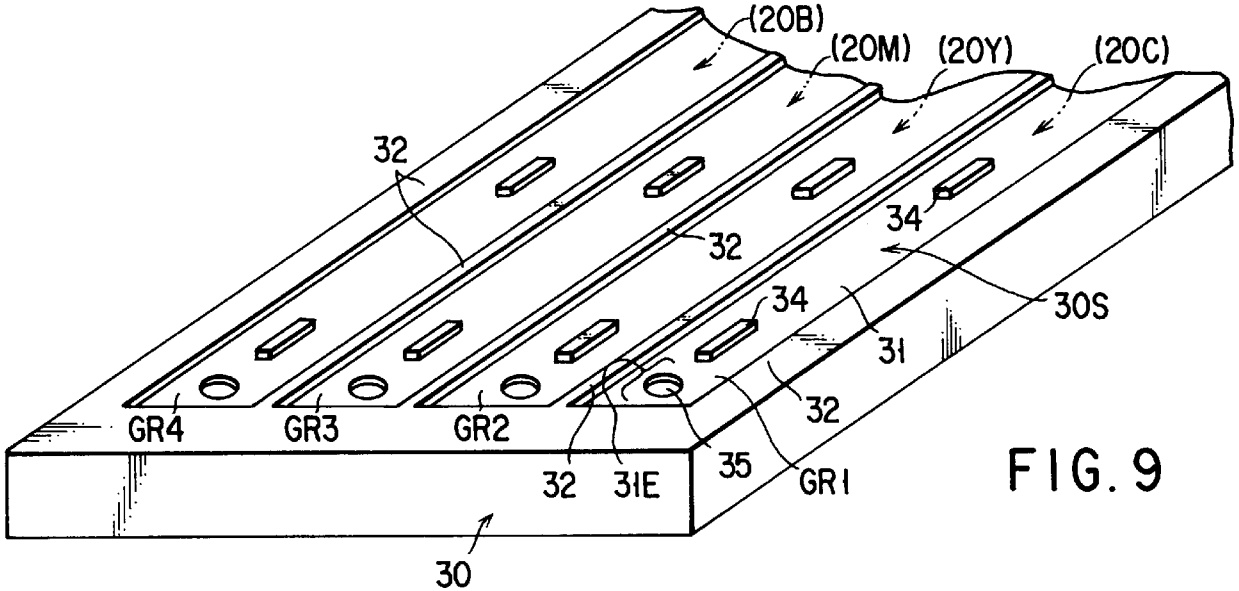
FIG. 9
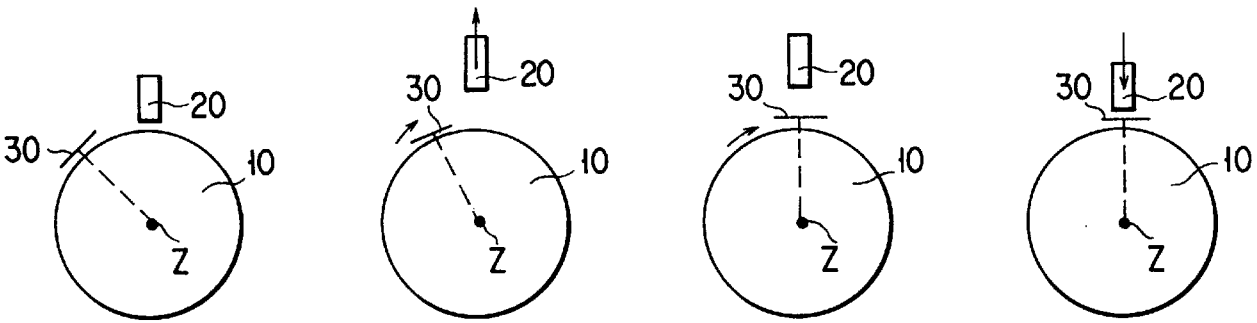
FIG. 10A
FIG. 10B
FIG. 10C
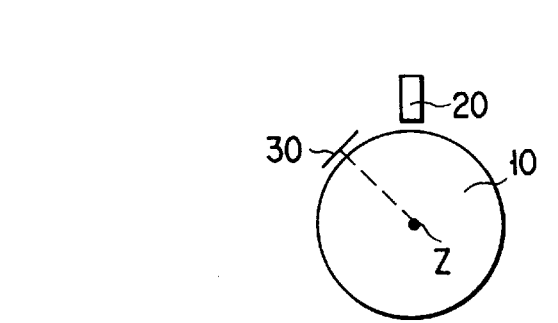
FIG. 10D

INK-JET PRINTER

BACKGROUND OF THE INVENTION

The present invention relates to an ink-jet printer which prints an image onto a print medium held on a rotary drum with ink ejected from a print head, and particularly, to an ink-jet printer whose print head is constructed by a plurality of ink-jet nozzles disposed in the axial direction of the rotary drum.

Conventionally, serial-type ink-jet printers are widely spreading. In the serial-type ink-jet printer, a print head and an ink cassette of a relatively small capacity are integrally mounted on a carriage, and the carriage is movably attached to a guide bar extending across a paper sheet. The paper sheet is fed in a direction perpendicular to the guide bar at a constant pitch, and the carriage is moved along the guide bar each time the paper sheet is fed for one pitch. The print head ejects ink during the movement of the carriage. In the case where the printer is used for color printing, the print head includes a plurality of ink-jet nozzles which are respectively supplied with inks of different colors from ink tanks. In the structure as described above, for example, a color image of A4 size is printed out in ten minutes. Thus, the serial-type ink-jet printer operates at a slow print speed of 0.1 sheet per minute.

In recent years, a drum rotation type ink-jet printer has been developed to perform color printing at a higher speed. In this ink-jet printer, a paper sheet is held on a rotary drum rotating in only one direction, and a print head includes a plurality of nozzle units which are arranged along the peripheral surface of the rotary drum and eject inks of different colors other onto a paper sheet rotating together with the rotary drum. Each nozzle unit includes a plurality of ink-jet nozzles disposed across the paper sheet in the axial direction of the rotary drum. The pitch of the ink-jet nozzles is set to a value equal to a desired resolution or a value two to four times greater than the resolution. The print head is positioned such that the end surfaces of the ink-jet nozzles are close to the paper sheet on the rotary drum. The print head is set to a predetermined position in the case where the pitch of the ink-jet nozzles is equal to the desired resolution. The print head is set to be movable in the axial direction of the drum from the predetermined position in the case where the pitch of the ink-jet nozzles exceeds the desired resolution. When the print head is movable in the axial direction of the rotary drum, the print head is moved at a rate corresponding to the desired resolution, for each revolution of the rotary drum, and is returned to the predetermined position after the print head is moved for a distance equal to the pitch of the ink-jet nozzles. The rotation speed of the rotary drum is set to 120 rpm. In this structure, for example, a color image of A4 size can be printed out in about two or three seconds. Also, since the print head is not moved by a distance exceeding the nozzle pitch in the axial direction of the rotary drum, the number of prints to be obtained for each ink charge can be increased by setting large-capacity ink cassettes apart from the print head and supplying inks of different colors to the respective nozzle units of the print head.

In this ink-jet printer, the end surface of the print head corresponding to the end surfaces of all the ink-jet nozzles are close to a paper sheet with a gap of about 1 mm interposed therebetween. Therefore, during printing in which a paper sheet is rotated at a high speed by a rotary drum and moved relatively with respect to the ink-jet nozzles, paper particles scattered from the paper sheet easily adhere to the end surface of the print head. The paper particles are gradually accumulated and soak up ink on the end surfaces of the nozzles. If such paper particles drop on a paper sheet along with ink, the print quality is degraded. The degradation of the print quality is a more serious problem for a drum rotation type ink-jet printer in which the print head is used for a long period than for a serial type ink-jet printer in which the print head is replaced upon shortage of ink in an ink cassette of a small capacity.

However, since the gap between the end surface of the print head and a paper sheet is slight, it is difficult to remove safely and securely paper particles adhered to the end surface. Therefore, for example, a cleaning process may be performed at the non-printing time to remove the paper particles by moving the print head in the axial direction of the rotary drum from a printing position facing the peripheral surface of the rotary drum to a cleaning position not facing the peripheral surface of the rotary drum, and mechanically wiping the end surface of the print head with an elastic material such as rubber upon movement of the print head. In this case, the size of the drum rotation type ink-jet printer will be increased in accordance with the distance of moving the print head. Further, an increase of the print speed is hindered by time losses caused by moving the print head between the cleaning position and the printing position. In this respect, since the end surface of the print head is coated with a water repellent film so that ink is ejected from ink-jet nozzles through predetermined courses onto a paper sheet, the pressure to the elastic material and the moving speed of the print head must be appropriately restricted.

BRIEF SUMMARY OF THE INVENTION

An object of the present invention is to provide an ink-jet printer capable of quickly and safely removing paper particles adhered to an end surface of a print head without enlarging the size.

The present inventors paid attention to several points as follows. A water repellant film has a mechanically and thermally weak characteristic that the film is deformed or damaged when the film is rubbed with a blade made of hard rubber. Purging process such as prevention of clogging of nozzles and degassing can be carried out by ejecting ink from ink jet nozzles before starting printing and during printing halfway. Further, the present inventors have considered a technique of removing the paper particles by a flow of ink which is generated on the end surface of the print head by utilizing ink ejected for purge processing or a purge processing period.

According to the present invention, there is provided an ink-jet printer which comprises a rotary drum for carrying a print medium, a print head arranged above the rotary drum for printing an image by ejecting ink onto the print medium, a washing board facing the print head to wash an end surface of the print head with ink ejected from the print head, a control unit for controlling at a non-printing time the washing board to be set at a cleaning position located between the print head and the rotary drum and the print head to eject ink therefrom, wherein the washing board has a groove section which receives an entire end surface of the print head and a drain section for draining the ink ejected from the print head and flowing in contact with the end surface of the print head within the groove section.

The ink-jet printer ejects ink from the print head at the non-printing time to remove particles adhered to the end surface of the print head by a flow of ink generated between the end surface of the print head and the washing board. Thus,-the particles can be quickly, accurately and safely removed from the end surface of the print head. If the particles are removed as described above during the continuous printing, the printing quality would not be degraded due to ink soaked into the particles and dropped on the printing medium. In the washing board placed at the cleaning position, ink is drained through the drain section and not unnecessarily overflow from the groove section. Therefore, required amount of ink can be reduced and color mixture can be prevented if inks of different colors are ejected from the print head and partitioned in the groove section. The groove section is opened at the sides of the print head even while ink is ejected, and ink is maintained in the groove section. Therefore, it is not necessary that the print head and the washing board are combined to create a closed room for ensuring removal of particles by a flow of ink.

Additional objects and advantages of the invention will be set forth in the description which follows, and in part will be obvious from the description, ar may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 9 is a perspective view schematically showing the outer appearance of the washing board shown in FIG. 2; and FIGS. 10A to 10D are views for explaining the motion of the washing board shown in FIG. 2.

DETAILED DESCRIPTION OF THE INVENTION

An ink-jet printer according to an embodiment of the present invention will be described with reference to the accompanying drawings.

Figure 1:
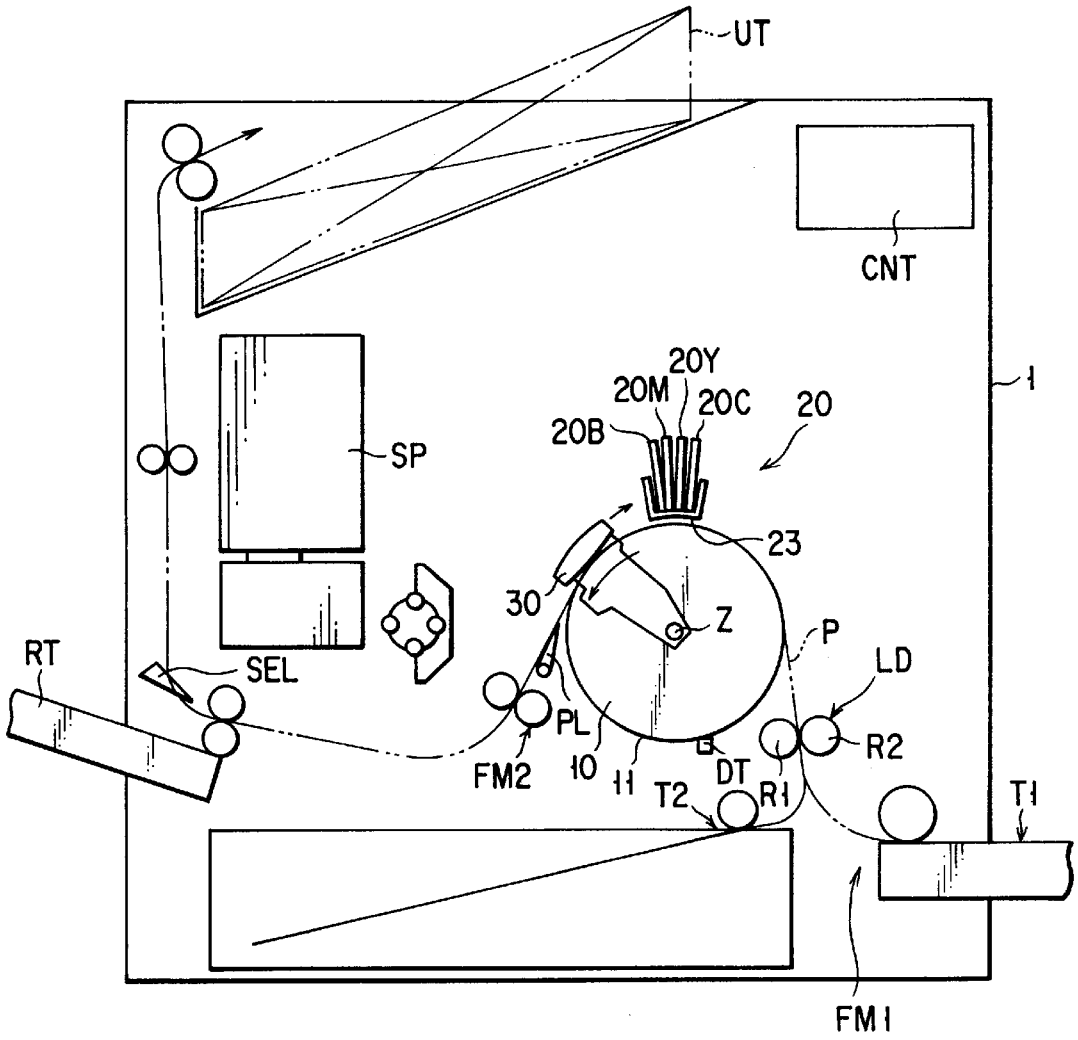
FIG. 1 is a view schematically showing the internal structure of an ink-jet printer according to an embodiment of the present invention.

FIG. 1 shows an internal structure of the ink-jet printer. The ink-jet printer is used to print a multicolor image on a paper sheet P cut as a printing medium. The paper sheet P may be a plain paper or OHP sheet.

The ink-jet printer includes a rotary drum 10 which holds a paper sheet P and rotates at a constant circumferential speed, and a print head 20 for printing a multicolor image on the paper sheet P rotating along with the rotary drum 10. The ink-jet printer also includes a manual feed tray T1 for a paper sheet P to be fed one by one, a paper cassette T2 for containing a stack of paper sheets M, a sheet feed-in mechanism FM1 for feeding a paper sheet P to the rotary drum 10 from the manual feed tray T1 and paper cassette T2, a sheet feed-out mechanism FM2 for feeding out the paper sheet P printed at the rotary drum 10, and a control unit CNT for controlling the overall operation of the ink jet printer. As shown in FIG. 1, the rotary drum 10 is located near the central position within a housing 1. The manual feed tray T1 is located below the rotary drum 10 and projects externally from a front surface of the housing 1, and the paper cassette T2 is located under the rotary drum 10. The sheet feed-in mechanism FM1 is placed between the manual feed tray T1 and the paper cassette T2. The print head 20 is located above the rotary drum 10. The sheet feed-out mechanism FM2 is located behind the rotary drum 10.

The rotary drum 10 is supported so as to be ratable about the axis, and holds the paper sheet P wound around a peripheral surface 11 in accordance with its rotation. The rotational position of the rotary drum 10 is detected by a rotational position detector DT provided near the peripheral surface 11 of the rotary drum 10. The print head 20 includes nozzle units 20C, 20Y, 20M, 20B which are arranged in series along the peripheral surface 11 of the rotary drum 10 from the upstream side to the down stream side so as to perform printing on the paper sheet P with inks of cyan, yellow, magenta and black. These nozzle units are supplied with inks of the corresponding colors from four ink supplying units SP remote therefrom. Each of the nozzle units 20C, 20Y, 20M, 20B has a plurality of ink-jet nozzles 23, arranged at pitch PT of, for example, 1/75 inch in the axial direction of the rotary drum 10, for ejecting the corresponding color ink to the paper sheet P. The ink-jet nozzles 23 are arranged to have a span correspond to 210 mm, i.e., the width of the paper sheet P of A4 size. The sheet feed-in mechanism FM1 includes a paper loader LD for loading the paper sheet P to the rotary drum 10 such that the width direction of the paper sheet P coincides with the axial direction of the rotary drum 10, and feeds the paper sheet P taken out of either the manual feed tray T1 or the paper cassette T2. The paper loader LD is controlled to feed the paper sheet P toward the rotary drum 10 when the position detector DT detects that the rotary drum 10 has arrived at a predetermined rotational position. The print head 20 prints a multicolor image on the paper sheet P as the rotary drum 10 rotates.

The paper sheet P is separated from the peripheral surface 11 of the rotary drum 10 by a paper separation unit PL and fed in a predetermined direction by the sheet feed-out mechanism FM2. The paper separation unit PL is a separation claw which is brought into contact with the rotary drum 10 at the time of separating the paper sheet. A discharge switch SEL guides the paper sheet P to a selected one of a rear discharge tray RT with the print surface facing upward, and an upper discharge tray UT with the print surface facing downward.

The print head 20 can be slightly and reciprocally shifted in a main scanning direction X parallel to the axis of the rotary drum 10. The rotary drum 10 holds the paper sheet P wound around and held on the peripheral surface 11, and rotates to move the paper sheet P in a sub-scanning direction Y perpendicular to the main scanning direction X, with the paper sheet P opposing to the nozzle units 20C, 20Y, 20M, 20B. To achieve a multicolor print of, for example, 20 PPM, the rotary drum 10 is maintained to be a constant rotation rate of 120 rpm; that is, it is rotated at one revolution per 0.5 second. In a printing operation, the print head 20 is shifted in the main scanning direction X at a constant rate of ¼ nozzle pitch PT every time the rotary drum makes one revolution, so that it moves by a distance equal to the nozzle pitch PT during four revolutions. With this structure, the printing of the entire surface of the paper sheet P is completed in 2 seconds (=0.5 second×4) required to make four revolutions of the rotary drum 10. Even when a time required to make one revolution of the rotary drum 10 for winding the paper sheet P around the drum before printing and one revolution of the rotary drum 10 for separating the paper sheet after printing, a multicolor image can be printed on the paper sheet P of A4 size at a high speed of 3 (=2+1) seconds per sheet. Thus, printing can be consecutively performed on 20 paper sheets every minute.

The paper loader LD includes at least a pair of feed rollers R1 and R2 extending in the axial direction of the drum 10 so as to load the paper sheet P supplied from the feeder T1 or T2 to the rotary drum 10 at a predetermined timing. The feed rate of the paper sheet P is set to the circumferential speed of the rotary drum 10. Since the diameter of the rotary drum 10 is 130 mm, a circumferential speed of 816 mm/sec can be obtained. The peripheral surface 11 of the rotary drum 10 is about 220 mm wide in the axial direction and 408 mm long in the rotational direction. Therefore, the rotary drum 10 can fully hold the A4 size paper sheet P having a length of 297 mm and a width of 210 mm.

Figure 3:
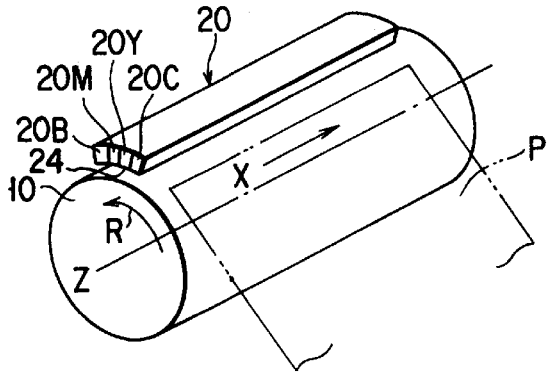
FIG. 3 is a perspective view showing a positional relationship between the print head and a rotary drum shown in FIG. 2.
Figure 2:
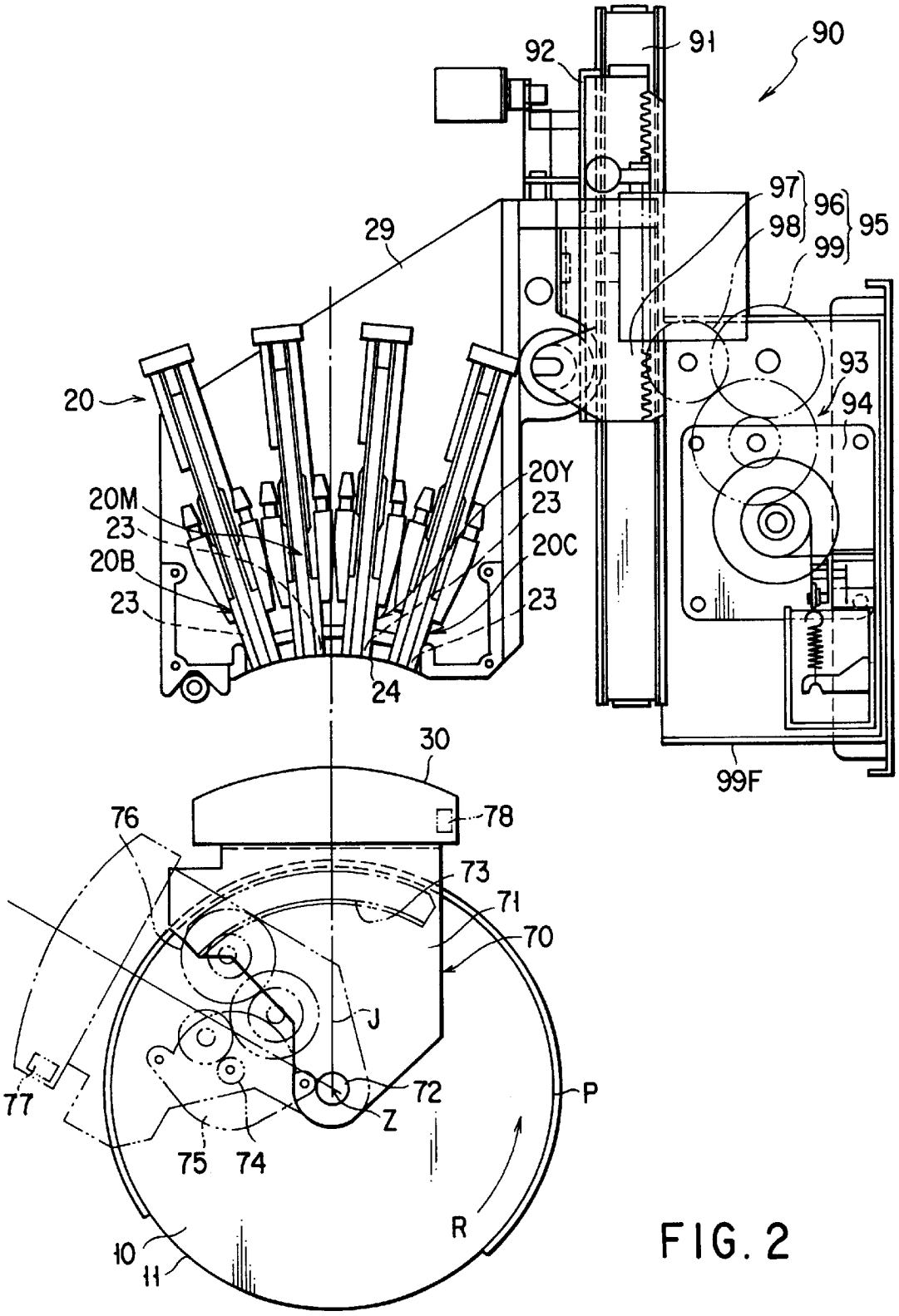
FIG. 2 is a view showing the structure around a print head shown in FIG. 1.

In the ink-jet printer, the rotary drum 10 and the print head 20 are positioned as shown in FIGS. 2 and 3, and a washing board 30 can be inserted between the print head 20 and the rotary drum 10. The washing board 30 is used to remove paper particles adhered to the end surface 24 with ink ejected from the ink-jet nozzles 23 of the nozzle units 20C, 20Y, 20M, 20B in a state where the washing board 30 faces the end surface 24 of the print head 20.

Figure 6:
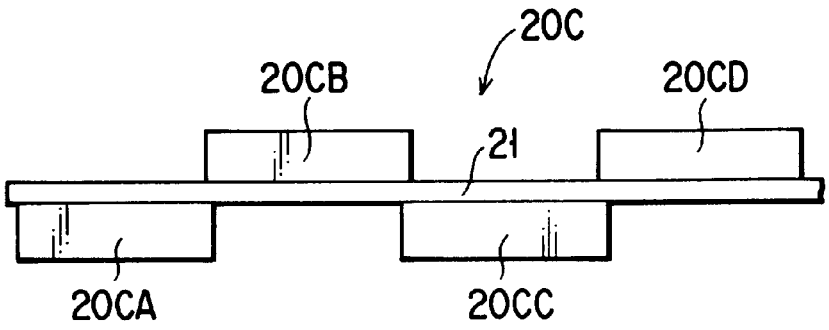
FIG. 6 is a top view of one nozzle unit shown in FIG. 2.
Figure 7:
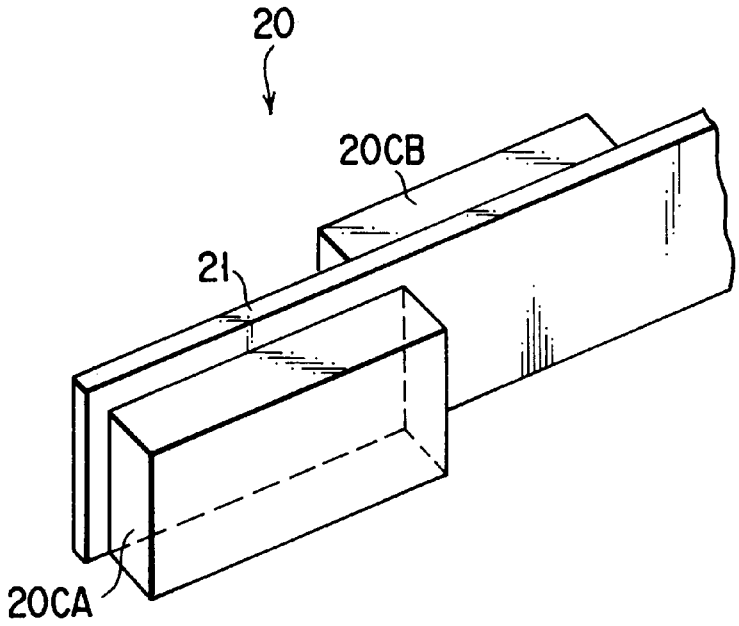
FIG. 7 is a perspective view schematically showing the outer appearance of the nozzle unit shown in FIG. 6.

The nozzle units 20C, 20Y, 20M and 20B are constructed to have the same structure. For example, the nozzle unit 20C has a joint plate 21 and four nozzle segments 20CA, 20CB, 20CC, and 20CD as shown in FIGS. 6 and 7. The joint plate 21 is set so as to extend in the axial direction X of the rotary drum 20 which coincides with the widthwise direction of a paper sheet P shown in FIG. 2. The nozzle segments 20CA, 20CB, 20CC, and 20CD are provided in a zigzag arrangement on the joint plate 21, shifted from each other in the rotation direction R of the rotary drum 10. Specifically, the nozzle segments 20CA and 20CC are fixed to the front surface of the joint plate while the nozzle segments 20CB and 20CD are fixed to the back surface of the joint plate. Pairs of adjacent nozzle segments 20CA and 20CB, 20CB and 20CC, and 20CC and 20CD are arranged so as to overlap each other slightly. The end surfaces of the ink-jet nozzles 23 of the nozzle segments 20CA, 20CB, 20CC, and 20CD are aligned to a height equal to the end surface 24 of the print head 20.

The height of the print head 20 is automatically adjustable by a lift 90. By the adjustment of the height, the print head 20 is set to a lower limit position shown in FIG. 10A at the printing time, and the print head 20 is set to an upper limit position shown in FIGS. 10B and 10C at the non-printing time. The print head 20 is set to a cleaning position shown in FIG. 10D at the purging time.

As shown in FIG. 2, the lift 90 is comprised of a pair of guide rails 91, a slider 92, and a lift drive section 93. The pair of guide rails 91 stand on one side of and in parallel to a vertical axis J passing through the axis Z of the rotary drum 10 and arranged in the axial direction X of the rotary drum 10. The slider 92 is slidably mounted on the guide rails 91, and supports the nozzle units 20C, 20Y, 20M, and 20B by a head support member 29. The lift drive section 93 elevates up and down the slider 92 by an electric power.

The pair of guide rails 91 stand on both ends of a fixed frame 99F in the axial direction X of the rotary drum 10. The slider 92 is supported by both of the guide rails 91. The lift drive section 93 is comprised of a motor 94, a power converter 95 for converting the rotation torque of the motor 94 into a force for lifting the slider 92, a rack-pinion mechanism 96 formed of a rack 97 and a pinion 98, and a power transmission gear mechanism 99.

The washing board 30 is rotatable around the axis Z of the rotary drum 10 as a center by a rotation position determination section 70, so that the washing board 30 can be selectively removably inserted between the print head 20 and the peripheral surface 11 of the rotary drum 10.

The rotation position determination section 70 includes a support frame 71, a power transmission gear mechanism 76, a drive motor 75, and position detection sensors 77 and 78. The section 70 is arranged to automatically determine the position of the washing board 30 at a selected one of a rest position where the section 70 is inclined by 45 degrees to the left side as shown in FIG. 10A and at a cleaning position shown in FIGS. 10C and 10D.

The support frame 71 is formed to be rotatable around the axis Z of the rotary drum 10 via a support shaft 72 while supporting the washing board 30 as shown in FIG. 2. The support flame 72 has a slave gear 73 of an arc-like shape attached thereto. The slave gear 73 is connected through the power transmission gear mechanism 76 to a drive gear 74 on the axis of the drive motor 75 mounted on a stationary member like the housing 1. The position detection sensor 77 is provided to detect that the washing board 30 is positioned at the rest position, and the position detection sensor 78 is provided to detect that the washing board 30 is positioned at the cleaning position.

The washing board 30 is formed to be used in common by the nozzle units 20C, 20Y, 20M, and 20B, as shown in FIG. 9. That is, the washing board 30 includes four lines of grooves GR1 to GR4 for the nozzle units 20C, 20Y, 20M, and 20B. The grooves GR1 to GR4 extend in the axial direction of the rotary drum 10 along lines of the ink-jet nozzles 23, and partitioned by ink stopper walls 32. These grooves GR1 to GR4 are respectively associated with the nozzle units 20C, 20Y, 20M, and 20B to create four ink flow generation chambers 30S. The ink flow generation chambers 30S are defined as spaces surrounded by ink reception plates 31 serving as the bottoms of the grooves GR1 to GR4, the end surfaces 24 of the nozzle units 20C, 20Y, 20M, and 20B, and the ink stopper walls 32. Each ink reception plate 31 has a pair of drain holes 35 formed in non-opposed areas 31E located on the both sides of the end surface 24 in the axial direction of the rotary drum 10 and not opposed to the end surface 24 as shown in FIGS. 4B and 9. An ink drain section 50 is connected through the drain holes 35 to the ink flow generation chambers 30S so as to commonly drain inks ejected from the nozzle units 20C, 20Y, 20M, and 20B.

Figure 4A:
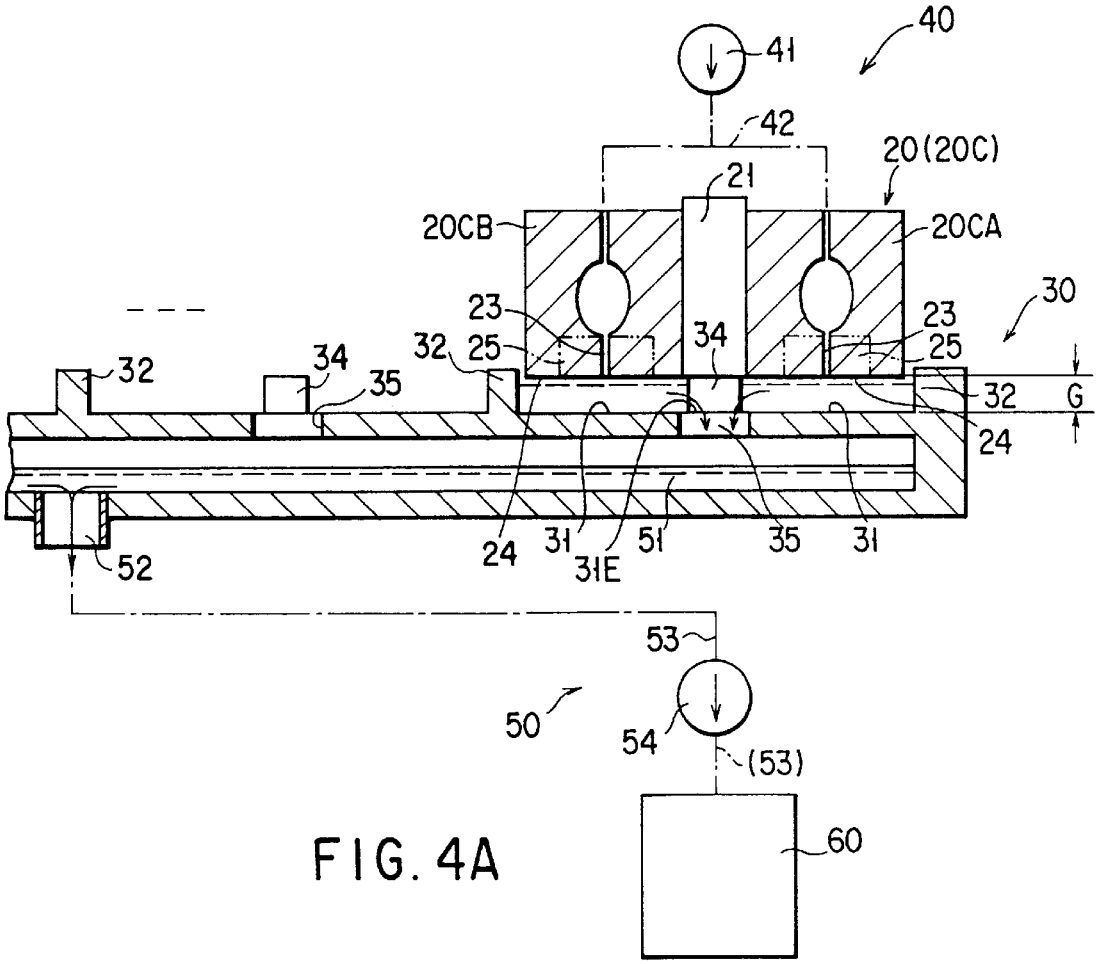
FIGS. 4A and 4B are views showing cross-sectional structures of the washing board shown in FIG. 2, in the direction perpendicular to the axial direction of the rotary drum and in the axial direction of the rotary drum, respectively.
Figure 4B:
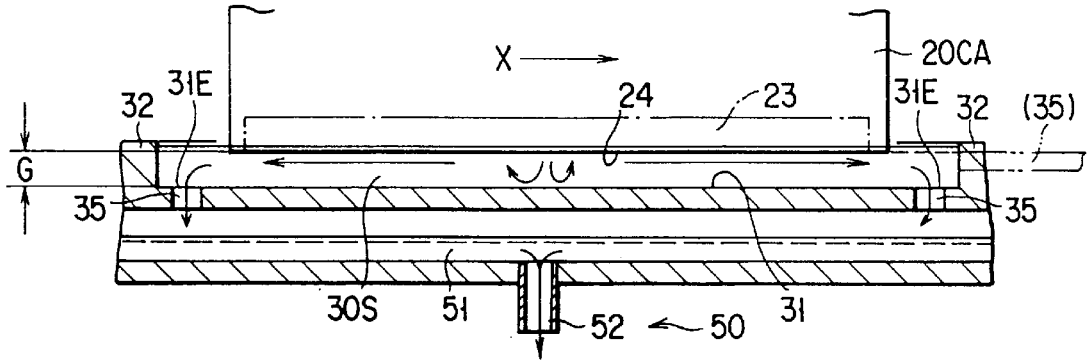
Figure 8:
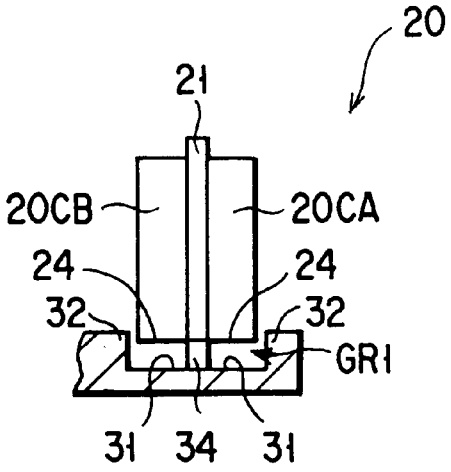
FIG. 8 is a view for explaining a structure which determines the positional relationship between the washing board and the nozzle unit shown in FIG. 2.

The washing board 30 further includes a plurality of projections projected from the ink reception plates 31 and serving as position determination member 34 for determining a gap G between the end surfaces 24 and the ink reception plates 31 as shown in FIGS. 4A and 4B. The lift 90 stops elevating down the print head 20 when the lower surface of the joint plate 21 is brought into contact with the upper surface of the position determination member 34, as shown in FIG. 8.

The gap G is a very important factor which decides the ink flow ability, the paper particle removal ability, and the necessary amount of ink. If the gap G is a value larger than 0.5 mm, for example, the necessary amount of ink is increased. Otherwise, if the gap G is a value smaller than 0.1 mm, for example, a smooth flow of ink cannot be guaranteed and it is difficult to obtain an accurate gap G. Therefore, the gap G of 0.3 mm is selected, which has led to the most desirable result in an experiment using a value within a range of 0.1 to 0.5 mm.

Figure 5A:
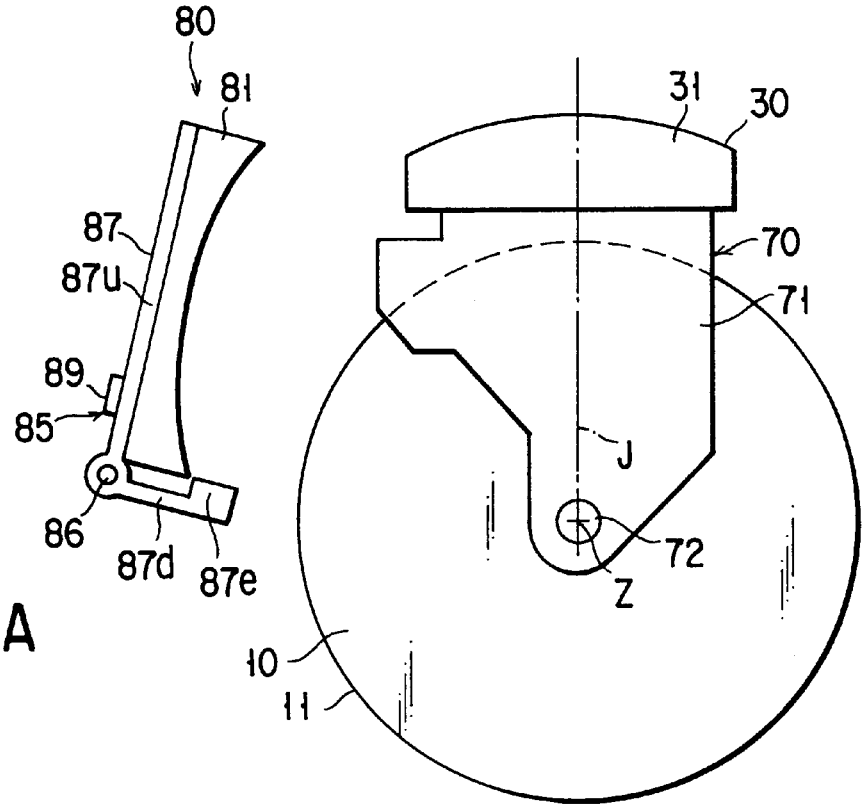
FIGS. 5A and 5B are views showing states of a dust cover for the washing board shown in FIG. 2.
Figure 5B:
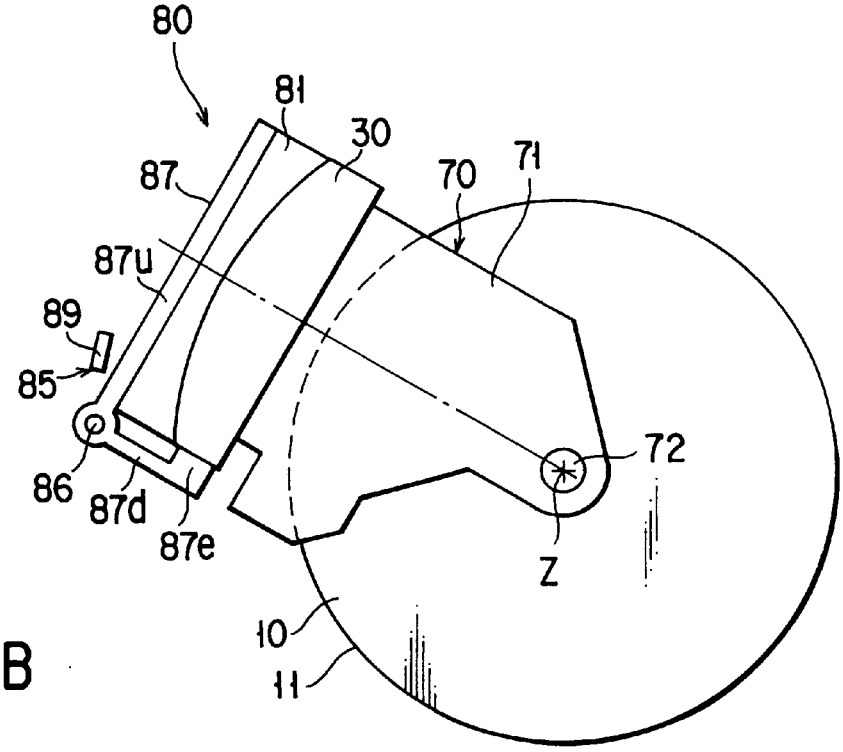

As shown in FIGS. 5A and 5B, the ink-jet printer includes a dust cover 80 for covering the ink reception plate 31 of the washing board 30 by utilizing the displacing motion of the washing board 30. The dust cover 80 is constituted by a cover portion 81 and an actuator portion 85 which brings the cover portion 81 into contact with the washing board 30.

The actuator portion 85 is constituted by a support member 87, an urge spring (not shown), and a stopper 89. The support member 87 is rotatably attached to a stationary member such as the housing 1 or the like via the support shaft 86. The urge spring urges the support member 87 in the counterclockwise direction in FIG. 5A. The cover portion 81 is attached to an upper portion 87*u* of the support member 87, and a lower portion 87*d* of the support member 87 is formed as an engaging portion 87*e* capable of being engaged with the washing board 30.

Therefore, when the washing board 30 is rotated toward the rest position as shown in FIG. 5B, the washing board 30 is engaged with the engaging portion 87*e* of the support member 87 to rotate the support member 87 in the counterclockwise direction. In this manner, the cover portion 81 is brought into tight contact with the washing board 30, thereby covering the ink reception plate 31.

The ink drain section 50 has a suction structure including a collection chamber 51 formed to be integral with the washing board 30, a drain pipe 52, a drain tube 53, and a suction pump 54.

The ink drain section 50 is driven by a controller (not shown) such that suction and drainage can be performed even while ink is ejected from the ink-jet nozzles 23. Specifically, in FIGS. 4A and 4B, the suction pump 54 is driven to drain ink by suction after the ink flow generation chamber 31S is filled with ink ejected from the nozzles 23 and the ink surface is brought into contact with the end surface 24. This reduces the necessary amount of ink.

In this embodiment, waste ink from the ink drain section 50 is collected by a waste ink cassette 60. The waste ink cassette 60 is detachably attached to the drain tube 53. Thus, no troubles are caused by dealing with waste ink and the periphery is not soiled even when continuous printing is carried out for a great deal of 2000 sheets of paper. Simultaneously, simplification and downsizing of the entire printer can be achieved. In addition, the collection chamber 51 permits a suction force from a single drain tube to be applied commonly to the plural drain holes 35. Therefore, the structure can be simplified while reducing the manufacturing cost. Further, the collection chamber 51 can prevents scattering of ink, which may be caused when the suction force from the drain tube 53 is directly applied to the drain holes 35.

Next, a paper particle removing operation of the ink-jet printer will be described. The control unit CNT performs a control of removing paper particles at the non-printing time (e.g., after printing operation is finished or while printing operation is paused). With this control, the lift 90 elevates up the print head 20 from a position shown in FIG. 10A to an upper limit position shown in FIG. 10B, and thereafter or simultaneously, the rotation position determination section 70 rotates the washing board 30 to be positioned at a position shown in FIG. 10C. In this state, the control unit CNT reverse the operation of the lift 90 to move down the print head 20 and stops it when the lower surface of the joint plate 21 is brought into contact with the position determination member 34 shown in FIG. 8 (shown in FIG. 10D). In this manner, a predetermined gap G (0.3 mm) is obtained between the end surfaces of the nozzle units 20Y, 20M, and 20B and the ink reception plates 31 of the washing board 30.

In this state, ink is supplied via a press pump 41 and a supply tube 42 to the print head 20 and is ejected from the ink-jet nozzles 23 toward the ink reception plate 31 so as to remove paper particles on the end surface of the print head 20. Prevention of clogging and degassing can be also achieved by this operation.

Ejected ink splashes from the ink reception plate 31 to contact with the end surface 24 of the print head 20, and then fills the ink flow generation chambers 30S while removing paper particles adhered to the end surface 24. A part of the ink drops from the pair of drain holes 35 formed in the non-opposed areas 31E shown in FIGS. 4A and 4B, and drained into the collection chamber 51.

In this state, the suction pump 54 of the ink drain section 50 suctions ink in the collection chamber 51 to drain it outside. By this suction, a flow of ink is generated in the ink flow generation chamber 30S and effectively removes paper particles adhered to the end surface 24. In this case, the paper particles are drained together with ink. Thus, no particles would be scattered again. Since the amount of ink necessary for filling the gap G of 0.3 mm and removing the paper particles is very small, shortage of ink would not occur even if paper particles are removed by using an amount of ink ejected for a purge process such as prevention of clogging and degassing.

In the embodiment, after the ink flow generation chambers 30S are filled with inks ejected (spitted) from the nozzles 23, switching is made such that inks are ejected at a high frequency (e.g., 50 KHz) like in normal printing, by a control of the ink-jet control elements 25 indicated by a two-dot chain line in FIG. 4A. This serves as a kind of ultrasonic cleaning function, so that paper particles adhered to the end surfaces 24 can be removed more securely. Further, clogging and gas can be also removed by this function.

The paper particle removing operation described above is simultaneously carried out for the nozzle units 20C, 20Y, 20M, and 20B, and completed within about 5 seconds.

After removal of paper particles, the print head 20 and the washing board 30 are quickly moved in the reverse order of FIGS. 10D, 10C, 10B, and 10A by the lift 90 and the rotation positioning section 70. Thus, a delay can be sufficiently suppressed when printing is restarted.

The washing board 30 is covered with the dust cover 80 which is responsive to the displacing motion of the washing board 30 directed to the rest position. The dust cover 80 protects the washing board 30 from paper particles and dusts at the printing time, and prevents the paper particles and dusts from being float up from the washing board 30 and adhered to the end surface 24 of the print head 20 by ink ejected for cleaning the end surface 24 of the print head 20 at the non-printing time.

As described above, the ink-jet printer of this embodiment ejects inks from the entire ink-jet nozzles 23 at the non-printing time to remove paper particles adhered to the end surface 24 by a flow of ink generated between the end surface 24 of the print head 20 and the washing board 30. Therefore, the paper particles can be removed quickly, securely, and safely. If the particles are removed as described above during the continuous printing, the printing quality would not be degraded due to ink soaked into the particles and dropped on the paper sheet. Further, the paper particle removing operation is automatically performed, easy handling can be achieved.

Moreover, in the ink-jet printer, the print head 20 is movable between positions close to and remote from the peripheral surface 11 of the rotary drum 10, and the washing board 30 is rotatable around the rotation center Z of the drum 10 to be set at a selected one of the rest position and the cleaning position. Therefore, the position of the washing board 30 can be more quickly and accurately changed, while reducing the space occupied for movement of the washing board 30. Accordingly, it is possible to remove paper particles adhered to the end surface 24 of the print head 20 more quickly without increasing the size of the ink-jet printer.

Since the washing board 30 is covered with the dust cover 80 at the rest position, there is no paper particles and dusts which will be float up from the washing board 30 and adhered to the end surface 24 of the print head 20 by ink ejected in a state where the washing board 30 is placed at the cleaning position. Accordingly, an effective cleaning of removing paper particles from the end surface can be more effectively carried out by ejecting ink.

Also, the ink reception plate 31 corresponding to the print heads (20C, 20Y, 20M and 20B) is formed integrally, so that the ink reception plate 31 can be positioned at the paper particle removal position. Removal of paper particles from the entire print head unit 20U can be performed in a much shorter period.

Further, since four lines of grooves GR1 to GR4 are integrally formed in the washing board 30 for the nozzle units 20C, 20Y, 20M, and 20B, removing operations of paper particles for the units can be simultaneously completed in a single process of setting the washing board 30 at the cleaning position and ejecting ink from all the nozzle units 20C, 20Y, 20M, and 20B. Therefore, the paper particles for the print head can be removed in a short period of time.

Ink is drained only through the drain holes 35, and not unnecessarily flow into the outside of the grooves GR1 to GR4 over the ink stopper walls 32. Therefore, required amount of ink can be reduced and color mixture can be prevented. The grooves GR1 to GR4 are opened at the sides of the print head even while ink is ejected, and ink is maintained in the grooves GR1 to GR4. Accordingly, it is not necessary that the print head 20 and the washing board 30 are combined to create a closed room for ensuring removal of particles by a flow of ink.

Since the ink drain section 50 drains ink through the drain holes 35 while ink is ejected, the necessary amount of ink can be reduced much more while more improving the ink flow ability.

Since the pair of drain hales 35 are formed in the ink reception plate 31 and separated from each other on both sides of the nozzle unit to distribute ink toward two ends in the ink flow generation chambers 30S. Therefore, it is possible to attain a smooth flow at a high speed while reducing the necessary amount of ink.

Since the gap G between the ink reception plate 31 of the washing board 30 and the end surface 24 is set to 0.3 mm, the effect of removing paper particles can be promoted much more and the necessary amount of ink thereby required can be reduced greatly. Also, automatic removal of paper particles can be facilitated much more while more downsizing the entire printer.

In each of the nozzle units 20C, 20Y, 20M and 20B, the nozzle segments 20CA, 20CB, 20CC, and 20CD are attached to the joint plate 21 such that the end surfaces of the ink-jet nozzles 23 thereof are aligned with each other, and the gap G is formed by bringing the lower surface of the joint plate 21 into contact with the upper surface of the position determination member 34. Therefore, even if the gap G has a small value of 0.1 to 0.5 mm, the gap G can stably be formed without an error.

The washing board 30 is set at the cleaning position during the print standby period, irrespective of cleaning of the print head 30. In this case, even if ink is leaked and dropped from the ink-jet nozzle 23, it can be collected by the waste ink cassette 60 via the ink drain section 50. Therefore, paper sheet is prevented from being contaminated by ink. Further, since the waste ink cassette 60 is detachable, it is possible to carry out continuous printing for a long period without increasing the size of the printer if waste ink is discarded at an appropriate interval.

Even when continuous printing is carried out for a great deal of 2000 sheets of paper, no troubles are caused by dealing with waste ink and the periphery is not soiled even when continuous printing is carried out for a great deal of 2000 sheets of paper. Simultaneously, simplification and downsizing of the entire printer can be achieved. In addition, the collection chamber 51 permits a suction force from a single drain tube to be applied commonly to the plural drain holes 35. Therefore, the structure can be simplified while reducing the manufacturing cost. Further, the collection chamber 51 can prevents scattering of ink, which may be caused when the suction force from the drain tube 53 is directly applied to the drain holes 35.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a medium carrier for carrying a print medium;

a print head arranged above said medium carrier for printing an image by ejecting ink onto the print medium;

a washing board facing said print head to wash an end surface of said print head with ink ejected from said print head; and a control unit for controlling at a non-printing time said washing board to be set at a cleaning position located between said print head and said medium carrier and said print head to eject ink therefrom;

wherein said washing board has a groove section which receives an entire end surface of said print head, and a drain section for draining the ink ejected from said print head and flowing in contact with the end surface of said print head within said groove section.

2. An ink-jet printer according to claim 1, wherein:

said print head includes at least nozzle unit, each nozzle unit having a plurality of ink-jet nozzles arranged in an axial direction of said medium carrier; and said control unit includes a mechanism for rotating said washing board around the axis of said medium carrier and elevating up and down said print head.

3. An ink-jet printer according to claim 2, further comprising a dust cover for covering said washing board upon displacing movement of said washing board from the cleaning position.

4. An ink-jet printer according to claim 3, wherein:

said print head includes a plurality of said nozzle units; and said groove section is opposed to said nozzle units.

5. An ink-jet printer according to claim 3, wherein:

said print head includes a plurality of said nozzle units; and said groove section includes a plurality of grooves partitioned for said nozzle units by a wall member.

6. An ink-jet printer according to claim 2, wherein said drain section includes a plurality of drain holes formed in an area which is located outside the end surface of said print head when the end surface of said print head is received in said groove section.

7. An ink-jet printer according to claim 6, wherein said drain section includes:

a suction structure having an ink collection chamber communicating said drain holes; and a suction pipe for applying an external suction force to said ink collection chamber.

8. An ink-jet printer according to claim 1, wherein said washing board includes a position determination member for contacting with a portion of said print head to define a distance between the end surface of said print head and a bottom of said groove section.

9. An ink-jet printer according to claim 8, wherein each ink nozzle unit includes:

a plurality of nozzle segments each including a predetermined number of ink-jet nozzles; and wherein a joint plate for supporting said nozzle segments, and said position determination member has a projection formed on the bottom of said groove section and facing said joint plate to be contacted therewith.

10. An ink-jet printer according to claim 1, wherein said control unit is arranged such that said washing board is maintained at the cleaning position during a print standby period to collect ink leaked from said print head.

11. A maintenance method for an ink-jet printer which prints an image by holding a print medium on a medium carrier and ejecting ink from a print head positioned above said medium carrier toward the print medium held on said medium carrier, the method comprising:

setting a washing board at a cleaning position located between said print head and said medium carrier;

washing the end surface of said print head by ejecting ink from said print head; and maintaining said washing board at the cleaning position to collect ink leaked from said print head, irrespective of the washing step.

* * * * *